US007093384B2

(12) United States Patent
Wong et al.

(10) Patent No.: US 7,093,384 B2
(45) Date of Patent: Aug. 22, 2006

(54) MIST IRON

(75) Inventors: Nyik Siong Wong, Singapore (SG); Yong Jiang, Singapore (SG); Tao Guo, Singapore (SG); Kumar Asok S/O Kasevan, Johor Baru (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 36 days.

(21) Appl. No.: 10/498,770

(22) PCT Filed: Dec. 3, 2002

(86) PCT No.: PCT/IB02/05122

§ 371 (c)(1),
(2), (4) Date: Jun. 15, 2004

(87) PCT Pub. No.: WO03/052194

PCT Pub. Date: Jun. 26, 2003

(65) Prior Publication Data

US 2005/0069302 A1 Mar. 31, 2005

(30) Foreign Application Priority Data

Dec. 19, 2001 (SG) ..... 2001078914

(51) Int. Cl.
*D06F 75/22* (2006.01)

(52) U.S. Cl. ..... 38/77.5

(58) Field of Classification Search ..... 38/77.1, 38/77.5, 77.6, 88, 93; 239/601, 602, 429, 239/433

See application file for complete search history.

(56) References Cited

U.S. PATENT DOCUMENTS

| | | | | | |
|---|---|---|---|---|---|
| 1,649,507 | A | * | 11/1927 | Brewer | 38/77.1 |
| 2,165,541 | A | * | 7/1939 | Foster | 38/77.6 |
| 2,817,169 | A | * | 12/1957 | Schott | 38/77.1 |
| 3,041,756 | A | * | 7/1962 | Foster | 38/77.5 |
| 3,237,325 | A | * | 3/1966 | Wagner et al. | 38/77.5 |
| 3,264,764 | A | * | 8/1966 | Vieceli | 38/77.5 |
| 3,552,046 | A | * | 1/1971 | Phifer | 38/77.5 |
| 5,787,614 | A | * | 8/1998 | Stutzer | 38/77.1 |

FOREIGN PATENT DOCUMENTS

GB 764205 12/1956

* cited by examiner

*Primary Examiner*—Ismael Izaguirre
(74) *Attorney, Agent, or Firm*—Adam L. Stroud

(57) ABSTRACT

An iron comprising a housing (1), a heatable soleplate (4) and means for generating very fine liquid droplets to be expelled from at least one discharge opening (9) of the iron, said means comprising at least one air passage (8) for pressurized air supply and at least one liquid passage (13) for pressurized liquid supply, said air passage (8) and said liquid passage (13) communicating with each other for mixing air and liquid, said mixture of air and liquid being supplied to the discharge opening (9). To improve the generation of fine liquid droplets (mist) an outlet of the liquid passage (8) ends into the air passage (13) upstream of the discharge opening (9) to introduce liquid into the air passage and an outlet of the air passage is provided with a nozzle (10) having said discharge opening (9). Preferably the pressurized air and liquid supply is obtained by means of electric pumps (6,7). The liquid may be water or a (diluted) additive liquid.

9 Claims, 2 Drawing Sheets

MIST IRON

Figure 1:
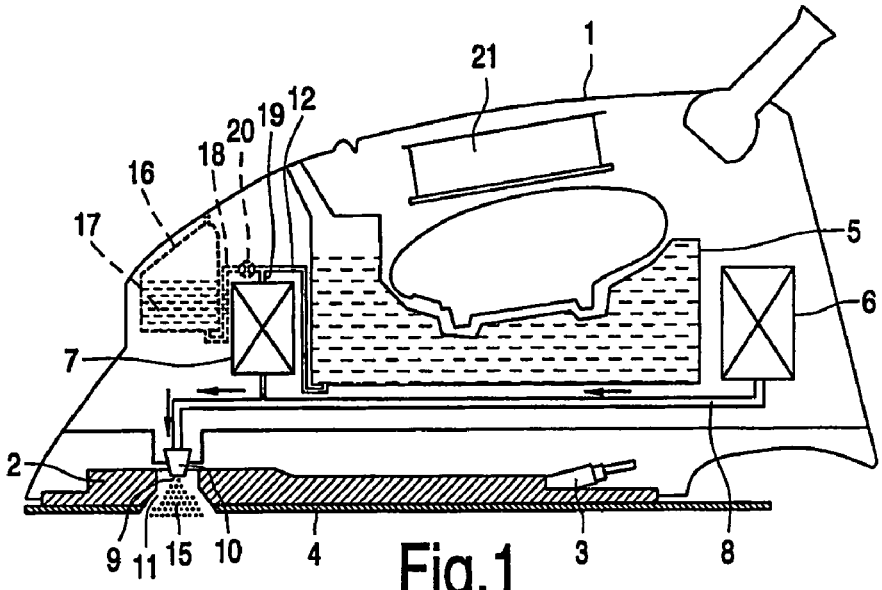

The invention relates to an iron comprising a housing, a heatable soleplate and means for generating very fine liquid droplets to be expelled from at least one discharge opening of the iron, said means comprising at least one air passage for pressurized air supply and at least one liquid passage for pressurized liquid supply, said air passage and said liquid passage communicating with each other for mixing air and liquid, said mixture of air and liquid being supplied to the discharge opening.

To improve the ironing result it is generally known to moisten fabric before it is ironed. Moistening can, for example, be done by spraying water on the fabric. The fabric will absorb the water and after a while the fabric is moistened. Spraying water can be done by means of a separate container or by means of a spraying device provided on an iron. The way the fabric is moistened steadily depends on the user's skill. In general a homogeneous moistening of the fabric will not occur. The size of the droplets obtained in this way of spraying is relative big, often >200 μm. The fabric becomes wet beyond what is necessary, taking too long time to conduct ironing.

Another manner to moisten fabric is by means of steam. Steam irons are well known. During ironing steam penetrates in the fabric making the removal of wrinkles easier during the subsequent ironing stroke(s). This manner of moistening is more convenient for the user, however the moistening itself is not very satisfactorily. The temperature of the fabric rises rapidly to 100° C. resulting in little or no moistening. Often a part of the steam goes through the fabric, moistening the cover layer of the ironing board, which is, of course, not desired.

It is also known to use mist for moistening the fabric. The advantage of mist is that the droplets of mist can better moisturize the fibers than the droplets of spray as referred to hereinbefore. The size of the droplets of mist is 10–200 μm. By using a spray of mist wrinkles can be smoothed out much easier. The mist, existing of very fine droplets, can be expelled either via one or more nozzles at the front and/or sides of an iron or via an opening in the soleplate. Examples of irons using a spray of mist are described, for example, in U.S. Pat. No. 6,035,563 in which mist is generated by means of a piezo element, in U.S. Pat. No. 6,009,645 or U.S. Pat. No. 2,762,143 in which mist is generated by mixing water and steam, in FR 2764912 in which a flow of hot air is introduced into a spray of water, or in GB 764205 in which a flow of pressurized water and a flow of pressurized air are mixed, the latter being referred to in the opening paragraph hereof. In this known iron water supply tubes extends alongside air pressure supply tubes which are soldered or otherwise suitable united against the water supply tubes. Between the water and air tubes restricted orifices are provided which communicate the interiors of the tubes. In this manner compressed air is introduced into the water supply tubes to obtain a spray of fine water droplets. A disadvantage of this construction is that it is very difficult to obtain fine water droplets, because air is introduced into the water supply tube. In fact, such an iron would require a large airflow. There is a great chance that the iron will leak large water droplets, particularly at lower pressures.

It is an object of the invention is to improve the generation of fine droplets of liquid to be expelled from a discharge opening of the iron.

According to the invention, this object is achieved in that an outlet of the liquid passage ends into the air passage upstream of the discharge opening to introduce liquid into the air passage and an outlet of the air passage is provided with a nozzle having said discharge opening.

In contradiction to the iron described in GB 764205 liquid is introduced into the air passage. In fact the air passage is the main passage and provided with the nozzle. A desired spray of very fine liquid droplets can easy be obtained by dosing a small amount of liquid into the air passage.

It is of course possible to locate the liquid source and pressure source outside the iron as is used in the so-called 'system' irons, however, the iron according to a preferred embodiment of the invention comprises a liquid reservoir and an electric pump for generating a pressurized flow of liquid in said liquid passage. Although the source for generating an air flow could also be located outside the housing, similar to liquid source as described hereinbefore, however in a preferred embodiment the iron comprises an electric air pump for generating a pressurized air flow in said air passage. The advantage of using electric pumps for air and liquid is that a continuous and steady flow of very fine liquid droplets (mist) is obtained. With the handpump system of GB 764205 this is not possible. By controlling the electric pumps the size as well as the delivery of the fine liquid droplets can be adjusted. The flow rate is variable between 0–30 g/min., preferably between 5–15 g/min. Preferably the size of the droplets is between 50–150 μm and a delivery between 5–15 g/min. This leads to a moisture amount of 10–15% (% of moisture weight to fabric weight) giving an excellent wrinkle removing result.

A further preferred embodiment is characterized in that the iron comprises a flow divider having one inlet for pressurized air, a plurality of outlet passages for pressurized air, one inlet for pressurized liquid and a plurality of outlet passages for the mixture of liquid and air, each outlet passage for the mixture of liquid ending into a respective outlet passage for pressurized air. In this manner the iron comprises a plurality of nozzles for uniform spraying fine liquid droplets on the fabric.

In a further preferred embodiment the liquid can be a mixture of water and an additive liquid. Additives can be used to improve for instance the gliding performance or the wrinkling resistance. The additive liquid can be accommodated in a reservoir, for instance a removable cartridge, separate from a water reservoir.

Figure 2:
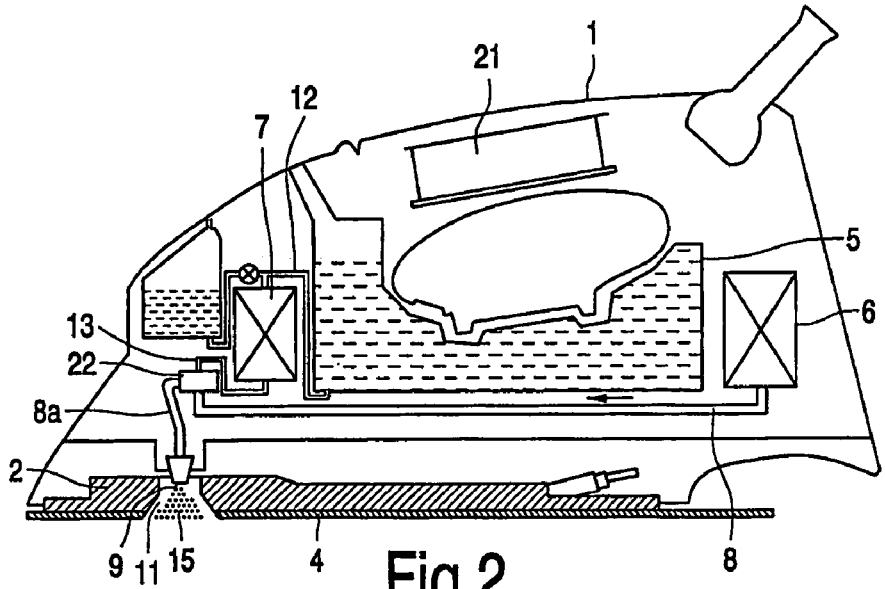
Figure 3:
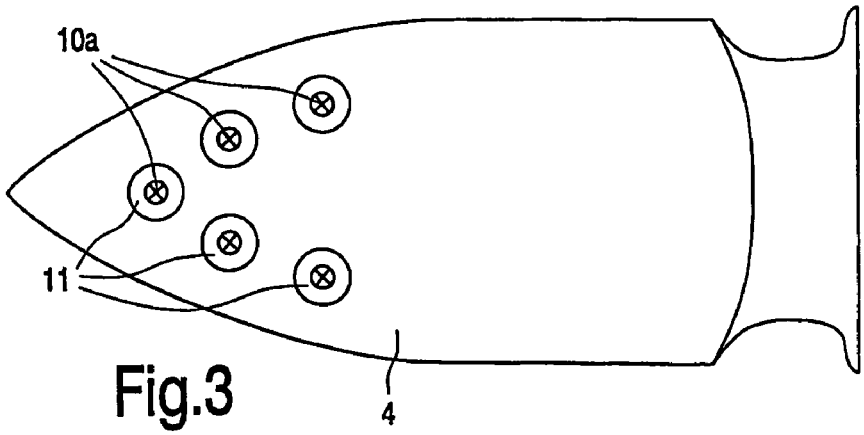
Figure 4A:
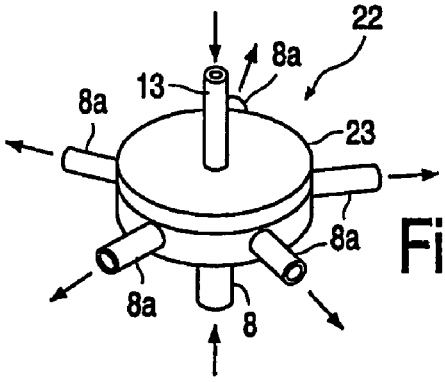
Figure 4B:
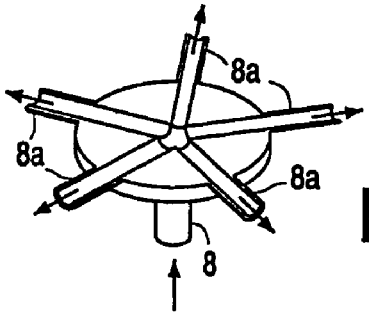
Figure 4C:
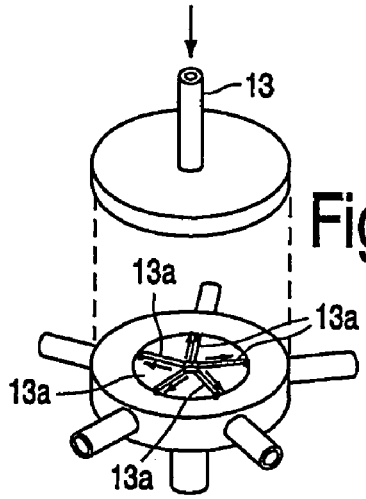
Figure 5A:
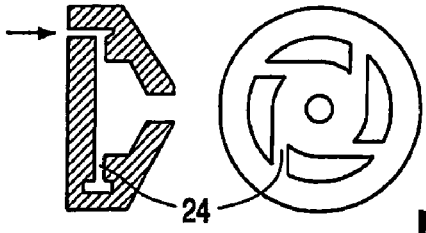

These and other aspects of the invention will now be apparent from and elucidated with reference to the embodiments described hereinafter:

FIG. 1 is a diagrammatic cross-sectional view of a first embodiment of an iron, FIG. 2 is a diagrammatic cross-sectional view of a second embodiment of an iron, FIG. 3 is a bottom view of the iron of FIG. 2, FIGS. 4*a,b,c,d* show a flow divider, FIGS. 5*a,b,c* show several examples of cyclone nozzles.

The first embodiment of an iron, shown in FIG. 1, has a housing 1, the open lower side thereof being covered by a heatable structure comprising a die casted block 2 in which a heating element 3 is incorporated and a soleplate 4 which is secured to the die casted block. Inside the housing a water reservoir 5, an electric air pump 6 and an electric water pump 7 are located. An air passage 8 connects the air pump 6 with a discharge opening 9 of a nozzle 10. In the casted block 2 and the soleplate 4 a mist chamber 11 is provided. The nozzle 10 ends in this mist chamber. A water supply channel 12 connects the water reservoir 5 with the electric water pump 7. A water passage 13 connects the outlet of the water pump 7 with the air passage 8 at a junction 14 upstream of the nozzle 10. In operation the air pump creates an airflow through the air passage 8 toward the nozzle 10. The water pump 7 creates a small water flow through the water passage 13. At the junction 14 a small amount of water is introduced into the air passage 8. The air with a small amount of water flows to the discharge opening 9 of the nozzle 10. A spray 15 of fine water droplets is generated at the discharge opening. The spray of droplets discharges into the mist chamber 11. The discharge opening of the nozzle is preferably 0.3–0.6 mm. The air pressure is in the range of 0.15–0.5 bar. In operation the mist chamber 11 is heated up to at least 100° C. to prevent dripping caused by droplet accumulated on the wall of the mist chamber.

In stead of generating a spray of pure fine water droplets it is also possible to add an additive liquid to the water, so that the fabric can be sprayed with a substance which, for example, improves the gliding performance, i.e. a lower resistance against gliding of the iron soleplate over the fabric or improves the wrinkling resistance, so that wrinkles will not be formed easy. Therefore the iron comprises a reservoir 16 containing an additive liquid 17. An outlet passage 18 of the additive reservoir is connected to the water supply channel 12 of the water reservoir 5 so as to form one single outlet passage 19 for the mixture of additive liquid and water (diluted additive) to the electric liquid pump 7. The outlet passage 18 may further comprise an adjustable valve 20 to control the additive liquid flow and thus the degree of dilution of the liquid. If the valve 20 is shut off only a spray of fine water droplets is obtained. Preferably the additive reservoir 16 is a removable cartridge.

The iron further comprises a control unit 21 to control the power of the pumps 6 and 7 and thereby the flow and pressure in the passages 8 and 13 respectively. The control unit may also control the valve 20 and thus the flow of the additive liquid.

Figure 4D:
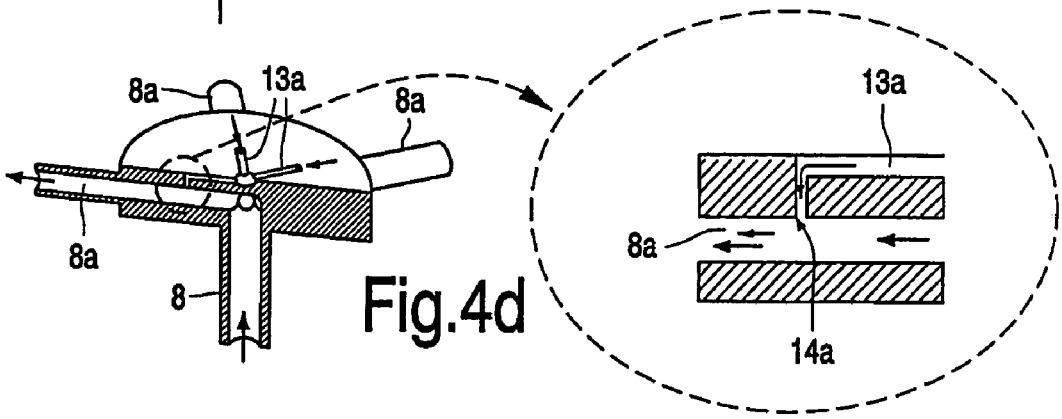
Figure 5C:
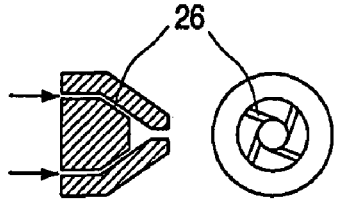
Figure 5B:
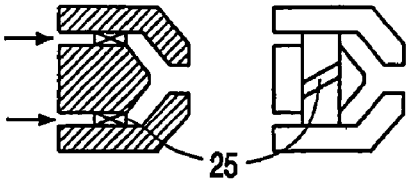

A second embodiment of an iron, shown in FIG. 2, in which similar parts are indicated with the same reference number as in FIG. 1, comprises a flow divider 22, details of which are shown in FIGS. 4*a,b,c,d*. The flow divider comprises a housing 23 having a central inlet air passage 8 for pressurized air, a plurality of outlet passages 8*a* for pressurized air, a central inlet passage 13 for liquid (pure water or water diluted with an additive liquid) and a plurality of outlet passages 13*a* for said pressurized liquid. Each outlet passage 13*a* for pressurized liquid ends into a respective outlet passage 8*a* for pressurized air at the junction 14*a*. This is clearly shown in the cross-sectional view of FIG. 4*d*. The shown flow divider 22 has 5 outlet passages 8*a* each ending into a nozzle 10*a*, so that at 5 positions of the soleplate mist is generated (see FIG. 3), thereby obtaining a better uniform moistening of the fabric. Good results with a continuous and steady flow of mist between 5–15 g/min. are obtained with an iron having 5 of such mist spray nozzles with the following data:

For operating air pressure: 0.15–0.5 bar:

Typically air flow rate 2–3 l/min for 5 cone nozzles with orifice size of 0.3–0.6 mm Liquid flow area (ducts 14*a*): 0.1–1 mm Two-fluids flow area (outlet passage 8*a*): 1–3 mm The nozzles 10*a* are preferably of the cone type in order to create a cone type mist pattern 15. In FIGS. 5*a,b,c* several cone type nozzles are shown. In FIG. 5*a* the nozzle is provided with tangential holes or slots 24, in FIG. 5*b* there are axial helical slots 25 and in FIG. 5*c* the slots 26 extends conical.

The invention claimed is:

1. An iron comprising a housing, a heatable soleplate and means for generating very fine liquid droplets to be expelled from at least one discharge opening of the iron, said means comprising at least one air passage for pressurized air supply and at least one liquid passage for pressurized liquid supply, said air passage and said liquid passage communicating with each other for mixing air and liquid, said mixture of air and liquid being supplied to the discharge opening, wherein an outlet of the liquid passage ends into the air passage upstream of the discharge opening to introduce liquid into the air passage and an outlet of the air passage is provided with a nozzle having said discharge opening.

2. An iron as claimed in claim 1, wherein the iron comprises a liquid reservoir and an electric pump for generating a pressurized flow of liquid in said liquid passage.

3. An iron as claim in claim 2, wherein the iron comprises an electric air pump for generating a pressurized airflow in said air passage.

4. An iron as claimed in claim 3, wherein the iron comprises a flow divider having one inlet for pressurized air, a plurality of outlets for pressurized air, one inlet for pressurized liquid and a plurality of outlets for the mixture of liquid and air, each outlet for the mixture of liquid ending into a respective outlet for pressurized air.

5. An iron as claimed in claim 1, wherein the liquid is a mixture of water and an additive liquid.

6. An iron as claimed in claim 1, wherein the iron comprises a water reservoir and a reservoir for the additive liquid, both reservoirs having an outlet passage connected to each other to form one single outlet passage being said liquid passage.

7. An iron as claimed in claim 6, wherein the outlet passage of the additive reservoir comprises an adjustable valve.

8. An iron as claim in claim 1, wherein the nozzle is provide with a cyclone.

9. An iron as claimed in claim 1, wherein the nozzle(s) is (are) arranged in the soleplate.

* * * * *